US008814312B2

(12) United States Patent
Hara et al.

(10) Patent No.: US 8,814,312 B2
(45) Date of Patent: Aug. 26, 2014

(54) IMAGE FORMING APPARATUS

(75) Inventors: Masashi Hara, Ibaraki-ken (JP); Masahiro Nishihata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 225 days.

(21) Appl. No.: 13/427,956

(22) Filed: Mar. 23, 2012

(65) Prior Publication Data

US 2012/0262514 A1 Oct. 18, 2012

(30) Foreign Application Priority Data

Apr. 12, 2011 (JP) ..... 2011-088098

(51) Int. Cl.
*B41J 29/38* (2006.01)
*B41J 3/60* (2006.01)
*B41J 11/48* (2006.01)

(52) U.S. Cl.
CPC . *B41J 11/485* (2013.01); *B41J 3/60* (2013.01)
USPC ..... 347/16

(58) Field of Classification Search
CPC ..... B41J 3/60; B41J 3/62
USPC ..... 347/16
See application file for complete search history.

(56) References Cited

U.S. PATENT DOCUMENTS

2008/0166165 A1* 7/2008 Mohri ..... 399/397
2008/0246977 A1* 10/2008 Fujii et al. ..... 358/1.2

FOREIGN PATENT DOCUMENTS

JP 2001-282050 A1 10/2001

* cited by examiner

*Primary Examiner* — Matthew Luu
*Assistant Examiner* — Tracey McMillion
(74) *Attorney, Agent, or Firm* — Nath Goldberg & Meyer; Jerald L. Meyer

(57) ABSTRACT

An image forming apparatus includes: a first paper feed unit configured to feed a primary recording medium for double-sided printing; a second paper feed unit configured to feed a secondary recording medium for single-sided printing; a printing unit configured to perform sets of printing based on received job information, each of the sets of printing including double-sided printing on a first predetermined number of primary recording media and single-sided printing on a second predetermined number of secondary recording media; a print timing setting unit configured to set a print timing of each of the first print media and the second print media based on the first predetermined number and the second predetermined number; and a controller configured to perform control to transfer the primary recording media and the secondary recording media to the printing unit based on the print timing.

8 Claims, 5 Drawing Sheets

FIG. 5

| FEEDING PAPER SHEET | PRINTING TIME (sec/SET) | |
|---|---|---|
| | RELATED ART | EMBODIMENT |
| A4 - 1 SHEET + ENVELOPE - 1 SHEET | 7.1 | 2.1 |
| A4 - 2 SHEETS + ENVELOPE - 1 SHEET | 8.1 | 3.2 |
| A4 - 3 SHEETS + ENVELOPE - 1 SHEET | 9.2 | 5.3 |
| A4 - 4 SHEETS + ENVELOPE - 1 SHEET | 10.2 | 6.3 |
| A4 - 5 SHEETS + ENVELOPE - 1 SHEET | 11.3 | 7.4 |

FIG. 6

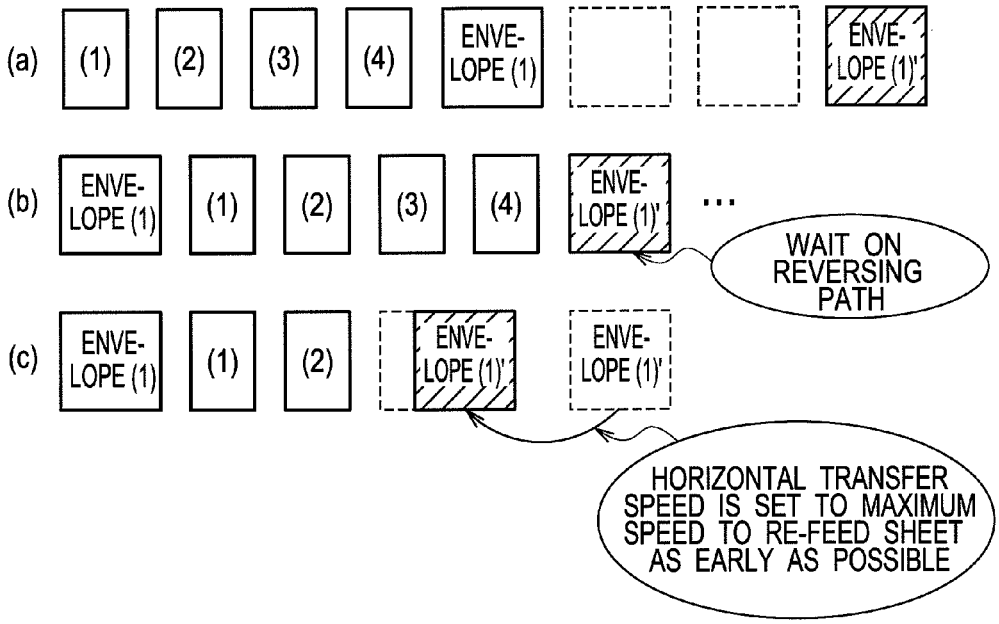

FIG. 7

| FEEDING PAPER SHEET | PRINTING TIME (sec/SET) | | |
|---|---|---|---|
| | RELATED ART | PATTERN 1 | PATTERN 2 |
| A4 - 1 SHEET + ENVELOPE - 1 SHEET | 3.4 | 2.9 | 2.1 |
| A4 - 2 SHEETS + ENVELOPE - 1 SHEET | 4.8 | 2.9 | 2.5 |
| A4 - 3 SHEETS + ENVELOPE - 1 SHEET | 6.3 | 3.0 | - |
| A4 - 4 SHEETS + ENVELOPE - 1 SHEET | 7.7 | 3.6 | - |
| A4 - 5 SHEETS + ENVELOPE - 1 SHEET | 9.2 | 4.1 | - |

IMAGE FORMING APPARATUS

CROSS REFERENCE TO RELATED APPLICATION

This application is based upon and claims the benefit of priority from the prior Japanese Patent Application No. 2011-088098, filed on Apr. 12, 2011, the entire contents of which are incorporated herein by reference.

BACKGROUND OF THE INVENTION

1. Field of the Invention

The present invention relates to an image forming apparatus capable of performing double-sided printing.

2. Description of the Related Art

There is an image forming apparatus which is provided with a circulating transfer path including a sheet reversing path and is capable of executing both of single-sided printing and double-sided printing. When single-sided printing is selected, the image forming apparatus of this type performs the single-sided printing by making printing on one of surfaces of a recording medium and then discharging the printed recording medium without using the sheet reversing path. On the other hand, when double-sided printing is selected, the image forming apparatus performs the double-sided printing by making printing on one of surfaces of a recording medium, then reversing the recording medium having the one surface already printed, by transferring the recording medium on the circulating transfer path, and then making printing on the other surface of the recording medium.

Japanese Patent No. 3880281 discloses an image forming apparatus including: a first detector configured to detect a sheet re-feed waiting state of a recording medium being transferred along a circulating path; a second detector configured to detect the sheet feed waiting states of a sheet for double-sided image formation and of a sheet for single-sided image formation by using a sheet feeder; a determination unit configured to determine, based on results of detection by the first detector and the second detector, whether or not a sheet for double-sided image formation is included within a feed waiting sheet range including twice as many sheets as the sheets from the first feed-waiting sheet to a re-feed waiting sheet for double-sided image formation; and a controller configured to treat the first feed waiting sheet as a sheet for double-sided image formation when the sheet for double-sided image formation is included in the feed waiting sheet range, and to thus perform control to re-feed the first feed waiting sheet along the circulating path.

The image forming apparatus disclosed in Japanese Patent No. 3880281 detects whether or not a sheet for double-sided image formation is included in the feed waiting sheet range including twice as many sheets as the sheets from the first feed-waiting sheet to a re-feed waiting sheet for double-sided image formation, treat the first feed waiting sheet as a sheet for double-sided image formation when the sheet for double-sided image formation is included in the feed waiting sheet range, and thus perform control to re-feed the first feed waiting sheet along the circulating path. In this way, the image forming apparatus is able to reduce processing time required for image formation including both of double-sided image formation and single-sided image formation, and thereby to prevent a decrease in productivity of image formation including both of the double-sided image formation and the single-sided image formation.

SUMMARY OF THE INVENTION

A printer designed for printing direct mails and also forming envelopes in an in-line manner is configured to form each direct mail by performing printing on an envelope and sheets of content material (e.g. letter sheets) in turn. In this case, the productivity of the printer is decreased when the envelope and the sheets of content material have different sheet sizes. In particular, an image forming apparatus configured to perform double-sided printing by using the sheet reversing (switch-back) path in the circulating path ensures the productivity by transferring sheets in accordance with a steady transfer schedule under the same printing conditions. Consequently, a change in the transfer schedule in the middle may result in a decrease in productivity.

FIGS. 1(*a*) and 1(*b*) are explanatory views schematically showing examples of double-sided printing patterns of an image forming apparatus of the related art. FIG. 1(*a*) shows a case of ordinary double-sided printing. In FIG. 1(*a*), N denotes the number of sheets transferable in the apparatus. FIG. 1(*a*) shows double-sided printing patterns of N=2 to 5. The value N is uniquely determined by a type of apparatus and a sheet size of recording medium. For example, for a certain apparatus, the value N is N=4 for printing on A4 sheets or N=2 for printing on B4 sheets. This is because the number of sheets held on the transfer path varies depending on the sheet size. FIG. 1(*a*) is also based on the assumption of N=4 for A4 size and N=2 for B4 size.

A rectangle with a solid frame represents a recording medium while a number in parentheses indicates a serial number of the sheet. A recording medium drawn as a hollow rectangle with a solid frame indicates a sheet for front-side printing. Meanwhile, a recording medium drawn as a shaded rectangle with a solid frame indicates a sheet for back-side printing. A rectangle with a broken frame indicates a transfer waiting period.

For example, in the case of N=2, the front face of a first sheet is printed in the first place. Then, after a waiting period, the front face of a second sheet is printed. Thereafter, the back face of the first sheet is printed (the printing on the first sheet is completed). Subsequently, the front face of a third sheet is printed and then the back face of the second sheet is printed (the printing on the second sheet is completed).

Here, the following problem may arise in transferring different sizes of sheets. Specifically, a transfer system for printing at constant time intervals to achieve double-sided printing at one-half of the productivity of single-sided printing decreases the productivity in printing on sheets having different sizes because the constant time intervals for printing cannot be maintained. Meanwhile, the timing for back face printing in double-sided printing is determined according to the sheet size and the length of the circulating transfer path, and therefore a loss equivalent to a paper feeding interval occurs. This loss more prominently occurs when there are different sizes of sheets. In particular, when double-sided printing is included in a print operation such as direct mail printing or form printing by alternate printing on sheets having difference sizes, the productivity of the print operation is decreased by frequent changes in the transfer schedule. This problem similarly occurs in the case of single-sided printing involving different sheet sizes.

For example, FIG. 1(*b*) shows a printing pattern in the case of performing double-sided printing on two A4 sheets and then double-sided printing on one B4 sheet. As shown in FIG. 1(*b*), the value N is determined as N=4 since the two A4 sheets are printed in the beginning. Accordingly, the front face of a first sheet is printed, then after a waiting period for one sheet, the front face of a second sheet is printed. Next, since there is no third or fourth sheet, after a waiting period for four sheets, the back face of the first sheet is printed. Then, after a further waiting period, the back face of the second sheet is printed.

When the printing on the two A4 sheets is completed, the value N is determined as N=2 to perform printing on one B4 sheet. A front face of the B4 sheet is printed in the beginning, and after a waiting period for two sheets, the back face of the B4 sheet is printed. In this way, the decrease in productivity is inevitable when there are different sheet sizes.

In addition, the technique disclosed in Japanese Patent No. 3880281 requires additional installation of the first detector and the second detector and also requires a new structure for keeping recording media on standby. Hence this technique makes the apparatus configuration more complicated and increased in size, and also has a difficulty in continuous sheet re-feeding.

An object of the present invention is to provide an image forming apparatus capable of completing printing on recording media having different sheet sizes within a reduced time with a simple structure and thereby improving productivity even when the recording media need to be printed by a combination of single-sided printing and double-sided printing.

An aspect of the present invention is an image forming apparatus comprising: a first paper feed unit configured to feed a primary recording medium for double-sided printing; a second paper feed unit configured to feed a secondary recording medium for single-sided printing; a printing unit configured to perform sets of printing based on received job information, each of the sets of printing including double-sided printing on a first predetermined number of primary recording media fed by the first paper feed unit and single-sided printing on a second predetermined number of secondary recording media fed by the second paper feed unit; a print timing setting unit configured to set a print timing of each of the first print media and the second print media based on the first predetermined number and the second predetermined number; and a controller configured to perform control to transfer the primary recording media and the secondary recording media to the printing unit based on the print timing set by the print timing setting unit.

According to this aspect, the image forming apparatus includes the print timing setting unit configured to appropriately set the print timing of the primary recording medium as a target for double-sided printing and of the secondary recording medium as a target for single-sided printing. Hence it is possible to complete printing on recording media having different sheet sizes within a reduced time with the simple structure and thereby to improve productivity even when the recording media need to be printed by a combination of single-sided printing and double-sided printing.

The print timing setting unit may set the print timing based on a number of one of the primary recording media and the secondary recording media transferable in the transfer path at a time.

According to this configuration, the print timing is set based on the number of the primary recording media or the secondary recording media transferable in the transfer path at a time. Thus, the print timing can be set more appropriately to improve productivity.

When the first predetermined number+1≥N where N denotes a number of the primary recording media transferable in the transfer path at a time, the print timing setting unit may set the print timing so as to perform printing on a front face of a first one of the primary recording media in a second set of printing next to a first set of printing at timing before printing on a back face of a (N−2)-th one of the primary recording media counted from the last in the first set and to perform printing on the secondary recording medium in the first set instead of feeding a (N−1)-th one of the primary recording media in the second set.

According to this configuration, the print timing can be set more appropriately, as follows, to improve productivity. Specifically, when the first predetermined number+1≥N where N denotes the number of the primary recording media transferable in the transfer path at a time, the print timing is set to perform printing on the front face of the first one of the primary recording media in the second set at the timing before printing on the back face of the (N−2)-th one of the primary recording media counted from the last in the first set, and to perform printing on the secondary recording medium instead of feeding the (N−1)-th one of the primary recording media in the second set.

When the first predetermined number+1<N where N denotes a number of the primary recording media transferable in the transfer path at a time, the print timing setting unit may set the print timing so as to perform printing on a front face of a first one of the primary recording media in a second set of printing next to a first set of printing at timing before printing on a back face of a last one of the primary recording media in the first set and to perform printing on the secondary recording medium in the first set at timing after printing on the back face of the last one of the primary recording media in the first set.

According to this configuration, the print timing can be set more appropriately, as follows, to improve productivity. Specifically, when the first predetermined number+1<N where N denotes the number of the primary recording media transferable in the transfer path at a time, the print timing is set to perform printing on the front face of the first one of the primary recording media in the second set at the timing before printing on the back face of the last one of the primary recording media in the first set, and to perform printing on the secondary recording medium at the timing after printing on the back face of the last one of the primary recording media in the first set.

When the first predetermined number is 1, the print timing setting unit may set the print timing so as to firstly perform printing on a front face of the primary recording medium, then to continuously perform printing on the second predetermined number of the secondary recording media, and to perform printing on a back face of the primary recording medium at timing of completion of printing on the secondary recording media.

According to this configuration, the print timing can be set more appropriately, as follows, to improve productivity. Specifically, when the first predetermined number is 1, the print timing is set to perform printing on the front face of the primary recording medium in the first place, then to continuously perform printing on the second predetermined number of the secondary recording media, and then to perform printing on the back face of the primary recording medium at the timing when printing on the secondary recording media is completed.

When time required for printing on the secondary recording media in each of the sets is longer than time required for transferring and reversing the primary recording medium, the controller may perform control, based on the print timing set by the print timing setting unit, to keep the primary recording medium after completion of printing on the front face thereof on standby until completion of printing on the secondary recording media, and then to transfer the primary recording medium to the printing unit in synchronization with the completion of printing on the secondary recording media.

According to this configuration, the print timing can be set more appropriately, as follows, to improve productivity. Specifically, when the time required for printing the secondary recording media in each of the sets is longer than the time required for reversing and transferring the first medium, the image forming apparatus performs control to keep the primary recording medium after completion of printing on the front face on standby until completion of printing on the secondary recording media, and then to transfer the primary recording medium to the printing unit in synchronization with completion of printing on the secondary recording media.

When time required for printing on the secondary recording media in each of the sets is shorter than time required for transferring and reversing the primary recording medium, the controller may perform control, based on the print timing set by the print timing setting unit, to transfer the primary recording medium to the printing unit in synchronization with completion of printing on the secondary recording media by increasing a speed for transferring and reversing the primary recording medium.

According to this configuration, the print timing can be set more appropriately, as follows, to improve productivity. Specifically, when the time required for printing the secondary recording media in each of the sets is shorter than the time required for reversing and transferring the first medium, the image forming apparatus performs control to increase the speed for reversing and transferring the first medium, and thereby to transfer the primary recording medium to the printing unit in synchronization with completion of printing on the secondary recording media.

BRIEF DESCRIPTION OF THE DRAWINGS

FIG. 5 is a table showing comparison between times required for printing on primary recording media and secondary recording media in one set by using the image forming apparatuses according to the related art and Embodiment 1 of the present invention.

FIG. 6(*a*) is a view for explaining a method of a related art, and FIGS. 6(*b*) and 6(*c*) are views for explaining operations of an image forming apparatus according to Embodiment 2 of the present invention.

FIG. 7 is a table showing comparison between times required for printing on primary recording media and secondary recording media in one set by using the image forming apparatuses according to the related art and Embodiment 2 of the present invention.

DETAILED DESCRIPTION OF THE EMBODIMENTS

An image forming apparatus 1 according to an embodiment of the present invention will be described below in detail with reference to the accompanying drawings.

Embodiment 1

In Embodiment 1 and Embodiment 2 of the present invention, a description is given, as an example, of a line-type image forming apparatus provided with multiple inkjet heads each including numerous nozzles and configured to perform printing on a recording medium on a line basis by discharging black and color inks from the respective heads.

Overall Configuration of Image Forming Apparatus

Figure 2:
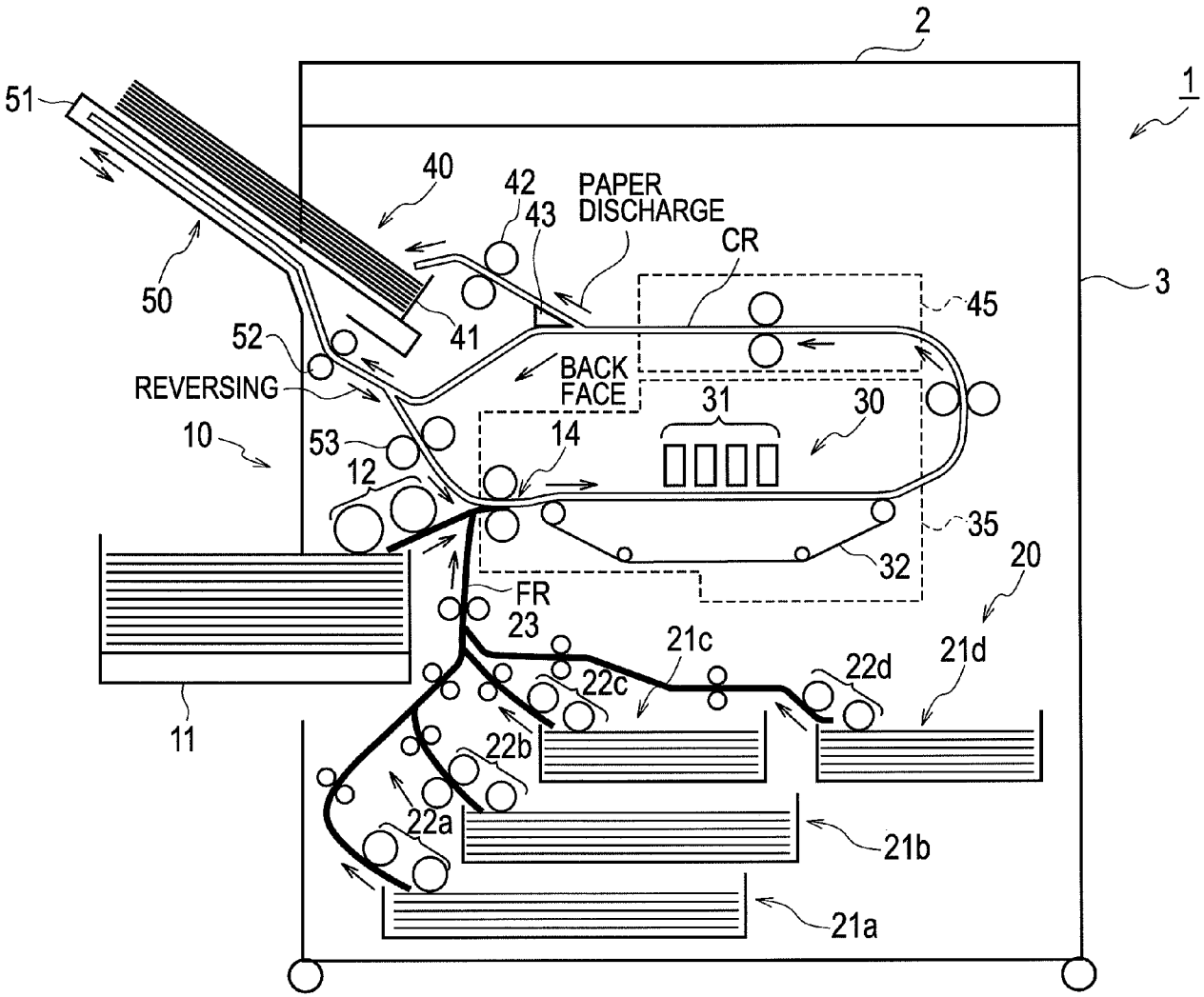
FIG. 2 is an overall configuration diagram showing a schematic configuration of an image forming apparatus according to Embodiment 1 of the present invention.

FIG. 2 is an overall configuration diagram showing a schematic configuration of an image forming apparatus 1 according to Embodiment 1 of the present invention. As shown in FIG. 2, the image forming apparatus 1 includes an image reader 2 and an image forming unit 3.

The image reader 2 is provided above the image forming unit 3 and includes a contact glass used for placing an original thereon, a cover detachably attached to this contact glass, a scanning unit configured to scan the original placed on the contact glass, a lens configured to focus the scanned image, and an image processor configured to process the focused image, which are not illustrated though.

This image reader 2 reads image data to be printed with the image forming unit 3 by causing the scanning unit to scan the original placed on the contact glass one line by one line and causing the image processing unit to process the scanned image.

The image forming unit 3 includes a side paper feed unit 10, an internal paper feed unit 20, a printing unit 30, a paper discharge unit 40, and a reversing unit 50.

The side paper feed unit 10 includes a paper feed tray 11 for loading recording media, a primary paper feed unit 12 configured to transfer only the uppermost recording medium in the paper feed tray 11 onto a paper feeding transfer path FR when the paper feed tray 11 is located in a paper feed position (a position in a vertical direction of the paper feed tray 11 where the recording media can be fed from the paper feed tray 11), and a secondary paper feed unit 14 configured to transfer the recording medium transferred by the primary paper feed unit 12 to the printing unit 30. The recording medium transferred on the paper feeding transfer path FR by the primary paper feed unit 12 strikes the secondary paper feed unit 14, and thereby the recording medium is positioned with its tip end aligned and with an inclination thereof corrected. Then, the recording medium is transferred on a circulating transfer path CR toward the printing unit 30 at predetermined timing.

The internal paper feed unit 20 includes paper feed trays 21*a*, 21*b*, 21*c*, and 21*d* configured to load print sheets W thereon, and primary paper feed units 22*a*, 22*b*, 22*c*, and 22*d* configured to transfer only the print sheets W in uppermost positions of the respective paper feed trays 21*a*, 21*b*, 21*c*, and 21*d* onto a paper feed transfer path SR.

A recording medium transferred from each of the primary paper feed units 22*a*, 22*b*, 22*c*, and 22*d* is then transferred on the paper feeding transfer path FR by multiple rollers such as transfer rollers 23 provided on the paper feeding transfer path FR. Then, when striking the secondary paper feed unit 14, the recording medium is positioned with its tip end aligned and an inclination thereof corrected. After that, the recording medium is transferred on the circulating transfer path CR toward the printing unit 30 at predetermined timing.

Any of the side paper feed unit 10 and the internal paper feed unit 20 can undertake a role as a first paper feed unit or a second paper feed unit of the present invention. In this embodiment, the primary paper feed unit 22*a* inside the internal paper feed unit 20 is assumed to correspond to the first paper feed unit of the present invention and to feed primary recording media (sheets of content material) each as a target for double-sided printing. Meanwhile, the primary paper feed unit 22*b* inside the internal paper feed unit 20 is assumed to correspond to the second paper feed unit of the present invention and to feed secondary recording media (envelopes) each as a target for single-sided printing.

The printing unit 30 includes a head unit 31 incorporating multiple printing heads, and an annular transfer belt 32 located so as to face the heat unit 31. The recording medium fed by the second paper feed unit 14 is suctioned onto the transfer belt 32 by use of an unillustrated suctioning unit installed in the annular transfer belt 32 and then transferred at a speed determined based on a printing condition. Thereafter, the recording medium is printed one line by one line using inks discharged from the head unit 31 and is then discharged.

In this embodiment, on the basis of received job information, the printing unit 30 performs sets of printing each including double-sided printing on a first predetermined number of primary recording media (sheets of content material) fed by the first paper feed unit (the primary paper feed unit 22*a*) and single-sided printing on a second predetermined number of secondary recording media (envelopes) fed by the second paper feed unit (the primary paper feed unit 22*b*). Here, it is a controller 70 to be described later which actually receives job information. Therefore, the printing unit 30 performs printing in response to a printing instruction signal based on the job information outputted from the controller 70.

The recording medium printed by and discharged from the printing unit 30 is transferred on the circulating transfer path CR by transfer rollers and the like which are installed on the circulating transfer path CR. The circulating transfer path CR is also provided with a switching mechanism 43 which is configured to switch between an operation to guide the recording medium transferred on the circulating transfer path CR toward the paper discharge unit 40 and an operation to recirculate the recording medium on the circulating transfer path CR (to guide the recording medium to the reversing unit 50).

The paper discharge unit 40 includes a paper receiving tray 41 having a shape of a tray protruding from a housing of the image forming apparatus 1, and a pair of paper discharge rollers 42 configured to guide the recording medium to the paper receiving tray 41. Accordingly, the recording medium printed by the printing unit 30 is transferred to the paper receiving tray 41 by the paper discharge rollers 42 and stacked face-down on the paper receiving tray 41.

The reversing unit 50 includes a reversing tray 51 configured to reverse the recording medium, and reversing rollers 52 configured to transfer the recording medium from the circulating transfer path CR to the reversing tray 51 or from the reversing tray 51 to the circulating transfer path CR.

The recording medium guided to the reversing unit 50 by the switching mechanism 43 is transferred from the circulating transfer path CR to the reversing tray 51 by the reversing rollers 52, and is turned over relative to the circulating transfer path CR after a lapse of a predetermined time by being transferred from the reversing tray 51 to the circulating transfer path CR. Thereafter, the recording medium thus turned over is transferred on the circulating transfer path CR by using multiple rollers such as transfer rollers 53 installed on the circulating transfer path CR and strikes the secondary paper feed unit 14. In this way, the recording medium is loosened and this looseness allows alignment of the tip end of the recording medium and correction of the inclination thereof. Thereafter, the recording medium is transferred on the circulating transfer path CR toward the printing unit 30 at predetermined timing.

Here, a transfer speed of the recording medium transferred in a printing area 35 on the circulating transfer path CR is set to an optimum printing speed Vp for ink discharge by the head unit 31. Although a description is given in this specification based on a constant transfer speed regardless of the sheet size of the recording medium, the speed may be adjustable depending on the sheet size.

Functional Configuration of Image Forming Apparatus

Figure 3:
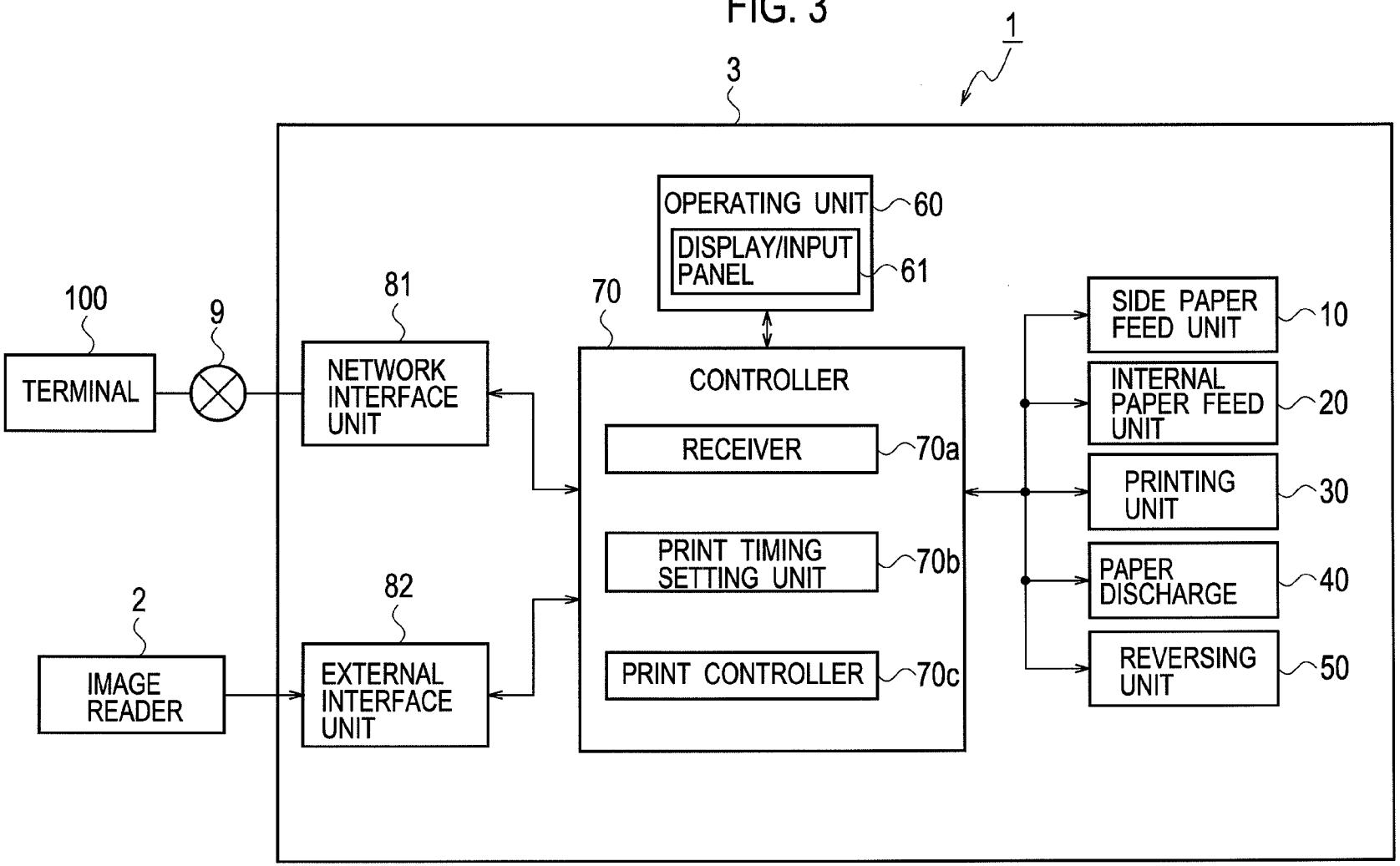
FIG. 3 is a functional configuration diagram showing a functional configuration of the image forming apparatus according to Embodiment 1 of the present invention.

FIG. 3 is a functional configuration diagram showing a functional configuration of the image forming apparatus 1 according to Embodiment 1. As shown in FIG. 3, the image forming apparatus 1 is connected to a terminal 100 through a network 9.

The terminal 100 executes software so as to generate image data and to transmit the generated image data as well as job information to the image forming apparatus 1 through the network 9. Here, the job information contains print setting information, which is a variety of setting information used for printing including a minimum paper feeding interval, the number of sheets in the path, the transfer speed, the sheet size, the number of copies to be printed, and so forth.

The image forming apparatus 1 includes the image reader 2 and the image forming unit 3. The image forming unit 3 includes the side paper feed unit 10, the internal paper feed unit 20, the printing unit 30, the paper discharge unit 40, the reversing unit 50, an operating unit 60, a controller 70, a network interface unit 81, and an external interface unit 82. Among these constituents, the side paper feed unit 10, the internal paper feed unit 20, the printing unit 30, the paper discharge unit 40, and the reversing unit 50 have been described above and therefore duplicated description will be omitted.

The operating unit 60 is located on an upper part of the image forming apparatus 1. The operating unit 60 is provided with various operating keys including a display/input panel 61, a start key for starting reading and printing operations and the like, a stop key for stopping the reading and printing operations and the like, a numeric keypad for inputting the number of copies to be printed and the like (none of these keys are illustrated). The operating unit 60 supplies operating signals based on operations by a user to the controller 70.

The display/input panel 61 of the operating unit 60 includes a transparent touch panel using either a pressure-sensitive mode or a static mode located on a front side, and a liquid crystal display panel located behind this touch panel (none of these panels are illustrated). A user can perform various operations to input settings including setting of the number of copies to be printed and so forth by directly touching a surface of the touch panel with a finger while watching a display screen on the liquid crystal display panel.

The network interface unit 81 is a communication interface such as a network card. By connecting the image forming apparatus 1 to the network 9 with this network interface unit 81, the image data are received from the terminal 100 connected to the network 9 and various signals are transmitted to and received from the terminal 100.

The external interface unit 82 is a connection interface with the image reader 2. The external interface unit 82 supplies the image data read by the image reader 2 to the controller 70.

The controller 70 is configured to perform central control of the image forming apparatus 1. Due to the functions thereof, the controller 70 includes a receiver 70*a*, a print timing setting unit 70*b*, and a print controller 70*c*.

The receiver 70*a* receives the job information transmitted from the terminal 100 through the network interface unit 81. Meanwhile, the receiver 70*a* receives the job information transmitted from the image reader 2 through the external interface unit 82.

The print timing setting unit 70*b* sets print timing of each of the primary recording media (sheets of content material) and the secondary recording media (envelopes) based on the first predetermined number and the second predetermined number. Meanwhile, the print timing setting unit 70*b* sets the print timing based on the number of primary recording media or the secondary recording media which can be transferred in the transfer path at a time. In this embodiment, the print timing setting unit 70*b* sets the print timing based on the number of primary recording media transferable in the transfer path at a time. Detailed operations of the print timing setting unit 70*b* will be described later.

The print controller 70*c* corresponds to a controller of the present invention which is configured to perform control to transfer the primary recording media and the secondary recording media to the printing unit 30 based on the print timing set by the print timing setting unit 70*b*. Specifically, the print controller 70*c* performs transfer control over the recording media by controlling the side paper feed unit 10, the internal paper feed unit 20, the paper discharge unit 40, the reversing unit 50, and the like based on the print timing set by the print timing setting unit 70*b*. At the same time, the print controller 70*c* generates a printing instruction signal based on the image data included in the job information received by the receiver 70*a*, and outputs the printing to cause the printing unit 30 to perform printing on the recording media.

Operation of Image Forming Apparatus

Figure 4:
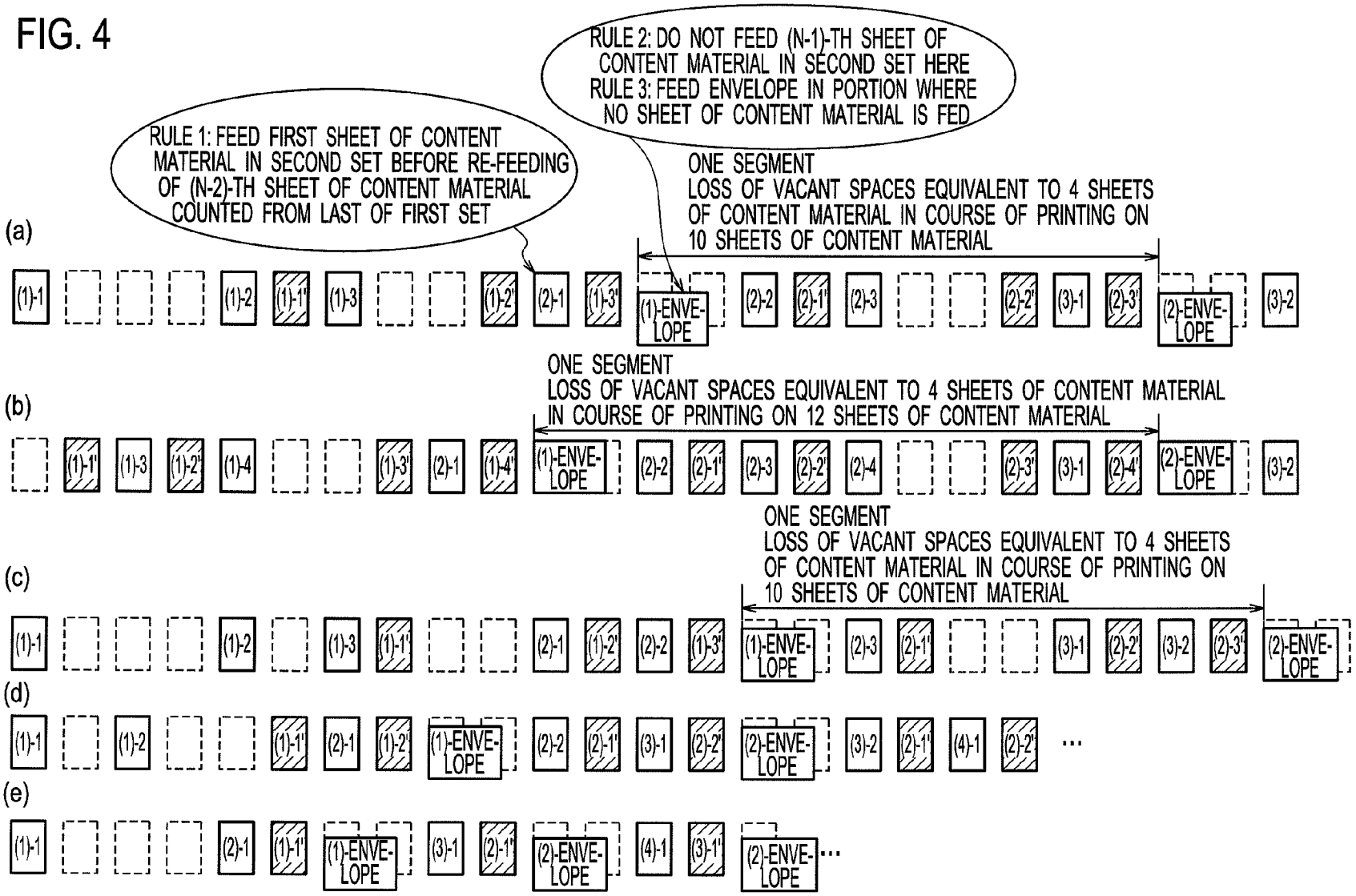
FIGS. 4(*a*) to 4(*e*) are views for explaining operations of the image forming apparatus according to Embodiment 1 of the present invention.

Next, operation of this embodiment configured as described above will be described. FIGS. 4(*a*) to 4(*e*) are views for explaining operations of the image forming apparatus 1 of this embodiment. In FIGS. 4(*a*) to 4(*e*), a rectangle drawn by a solid frame indicates a recording medium and a number in parentheses indicates the sequence number of a set to which the recording medium belongs. Further, a recording medium drawn as a hollow rectangle with a solid frame indicates front-side printing. Meanwhile, a recording medium drawn as a shaded rectangle with a solid frame indicates back-side printing.

Accordingly, (1)-1 indicates the front face of a first one of the primary recording media (sheet of content material) in a first set and (1)-2 indicates the front face of a second one of the primary recording media (sheet of content material) in the first set. Meanwhile, (1)-1' which is shaded indicates the back face of the first one of the primary recording media (sheet of content material) in the first set. Further, a rectangle with a broken frame indicates a transfer waiting period.

First of all, a pattern example 1 shown in FIG. 4(*a*) will be described. In the case of the pattern example 1, the printing unit 30 performs sets of printing each including double-sided printing on three primary recording media (sheets of content material) (A4 size in a portrait orientation) and single-sided printing on one secondary recording medium (envelope). Accordingly, the first predetermined number is 3 while the second predetermined number is 1.

First, when the receiver 70*a* of the controller 70 receives the job information, the print timing setting unit 70*b* sets the print timing for each of the primary recording media (sheets of content material) and the secondary recording medium (envelope) based on the first predetermined number (=3) and the second predetermined number (=1).

In addition, the print timing setting unit 70*b* sets the print timing based on the number of primary recording media transferable in the transfer path at a time. In the pattern example 1, the number of primary recording media transferable in the transfer path at a time is 3 and this number is set as N. That is, the value N is 3 in the pattern example 1. As described previously, the value N is uniquely determined by the type of apparatus and the sheet size of recording media.

When the first predetermined number+1≥N where N denotes the number of primary recording media transferable in the transfer path at a time, the print timing setting unit 70*b* sets the print timing so as to perform printing on the front face of a first one of the primary recording media in a second set at the timing before printing on the back face of an (N−2)-th one of the primary recording media counted from the last in the first set and to perform printing on the secondary recording medium instead of feeding an (N−1)-th one of the primary recording media in the second set.

Here, the first predetermined number is 3 and the value N is 3. Hence the first predetermined number+1≥N holds true. Therefore, the print timing setting unit 70*b* sets the print timing so as to perform printing on the front face of a first one of the primary recording media in a second set at the timing before printing on the back face of an (N−2)-th one of the primary recording media counted from the last in the first set. More specifically, as shown in FIG. 4(*a*), the print timing setting unit 70*b* sets the print timing so as to perform printing on the front face of the first one of the primary recording media in the second set (=(2)-1) at the timing before printing on the back face of the last one of the primary recording media in the first set (=(1)-3').

Moreover, the print timing setting unit 70*b* sets the print timing so as to perform printing on the secondary recording medium (=(1)-envelope) instead of feeding the second one of the primary recording media in the second set (=(2)-2). Here, as shown in FIG. 4(*a*), the print timing for the second one of the primary recording media in the second set (=(2)-2) is shifted backward, and the secondary recording medium (=(1)-envelope) is printed instead at that timing. Thus, the second one of the primary recording media in the second set is printed after printing on the secondary recording medium (=(1)-envelope).

A certain period of time for reversing and transferring the print medium is always necessary from a time point of printing on the front face to a time point of printing on the back face. When N=3, double-sided printing on a single print medium always involves four vacant spaces for four sheets from the time point of printing on the front face to the time point of printing on the back face. Accordingly, in the pattern example 1, there is a loss of vacant spaces equivalent to four sheets of content material in the course of printing on 10 sheets of content material. Therefore, the image forming apparatus 1 of this embodiment performs printing on the envelope at the timing of otherwise vacant spaces and thereby improves productivity.

The print controller 70*c* performs control to transfer the primary recording media and the secondary recording medium to the printing unit 30 based on the print timing set by the print timing setting unit 70*b*.

Similarly, a pattern example 2 shown in FIG. 4(*b*) will be described. In the case of the pattern example 2, the printing unit 30 performs sets of printing each including double-sided printing on four primary recording media (sheets of content material) (A4 size in a portrait orientation) and single-sided printing on one secondary recording medium (envelope). Accordingly, the first predetermined number is 4 while the second predetermined number is 1.

First, when the receiver 70*a* of the controller 70 receives the job information, the print timing setting unit 70*b* sets the print timing for each of the primary recording media (sheets of content material) and the secondary recording medium (envelope) based on the first predetermined number (=4) and the second predetermined number (=1).

In addition, the print timing setting unit 70*b* sets the print timing based on the number of primary recording media transferable in the transfer path at a time. In the pattern example 2, the number of primary recording media transferable in the transfer path at a time is 3 and this number is set as N. That is, the value N is 3 in the pattern example 2.

The first predetermined number is 4 and the value N is 3. Hence the first predetermined number+1≥N holds true. Therefore, the print timing setting unit 70*b* sets the print timing so as to perform printing on the front face of a first one of the primary recording media in a second set at the timing before printing on the back face of an (N−2)-th one of the primary recording media counted from the last in the first set. More specifically, as shown in FIG. 4(*b*), the print timing setting unit 70*b* sets the print timing so as to perform printing on the front face of the first one of the primary recording media in the second set (=(2)-1) at the timing before printing on the back face of the last one of the primary recording media in the first set (=(1)-4').

Moreover, the print timing setting unit 70*b* sets the print timing so as to perform printing on the secondary recording medium (=(1)-envelope) instead of feeding the second one of the primary recording media in the second set (=(2)-2).

In the pattern example 2, there is a loss of vacant spaces equivalent to four sheets of content material in the course of printing on 12 sheets of content material. Therefore, the image forming apparatus 1 of this embodiment performs printing on the envelope at the timing of otherwise vacant spaces and thereby improves productivity.

A pattern example 3 shown in FIG. 4(*c*) will be described. In the case of the pattern example 3, the printing unit 30 performs sets of printing each including double-sided printing on three primary recording media (sheets of content material) (A4 size in a landscape orientation) and single-sided printing on one secondary recording medium (envelope). Accordingly, the first predetermined number is 3 while the second predetermined number is 1.

First, when the receiver 70*a* of the controller 70 receives the job information, the print timing setting unit 70*b* sets the print timing for each of the primary recording media (sheets of content material) and the secondary recording medium (envelope) based on the first predetermined number (=3) and the second predetermined number (=1).

In addition, the print timing setting unit 70*b* sets the print timing based on the number of primary recording media transferable in the transfer path at a time. In the pattern example 3, the number of primary recording media transferable in the transfer path at a time is 4 and this number is set as N. That is, the value N is 4 in the pattern example 3.

The first predetermined number is 3 and the value N is 4. Hence the first predetermined number+1≥N holds true. Therefore, the print timing setting unit 70*b* sets the print timing so as to perform printing on the front face of a first one of the primary recording media in a second set at the timing before printing on the back face of an (N−2)-th one of the primary recording media counted from the last in the first set. In other words, as shown in FIG. 4(*c*), the print timing setting unit 70*b* sets the print timing so as to perform printing on the front face of the first one of the primary recording media in the second set (=(2)-1) at the timing before printing on the back face of the second one of the primary recording media counted from the last in the first set (=(1)-2').

Moreover, the print timing setting unit 70*b* sets the print timing so as to perform printing on the secondary recording medium (=(1)-envelope) instead of feeding the third one of the primary recording media in the second set (=(2)-3).

In the pattern example 3, there is a loss of vacant spaces equivalent to four sheets of content material in the course of printing on 10 sheets of content material. Therefore, the image forming apparatus 1 of this embodiment performs printing on the envelope at the timing of otherwise vacant spaces and thereby improves productivity.

A pattern example 4 shown in FIG. 4(*d*) will be described. In the case of the pattern example 4, the printing unit 30 performs sets of printing each including double-sided printing on two primary recording media (sheets of content material) (A4 size in a portrait orientation) and single-sided printing on one secondary recording medium (envelope). Accordingly, the first predetermined number is 2 while the second predetermined number is 1.

First, when the receiver 70*a* of the controller 70 receives the job information, the print timing setting unit 70*b* sets the print timing for each of the primary recording media (sheets of content material) and the secondary recording medium (envelope) based on the first predetermined number (=2) and the second predetermined number (=1).

In addition, the print timing setting unit 70*b* sets the print timing based on the number of primary recording media transferable in the transfer path at a time. In the pattern example 4, the number of primary recording media transferable in the transfer path at a time is 3 and this number is set as N. That is, the value N is 3 in the pattern example 4.

The first predetermined number is 2 and the value N is 3. Hence the first predetermined number+1≥N holds true. Therefore, the print timing setting unit 70*b* sets the print timing so as to perform printing on the front face of a first one of the primary recording media in a second set at the timing before printing on the back face of an (N−2)-th one of the primary recording media counted from the last in the first set. More specifically, as shown in FIG. 4(*d*), the print timing setting unit 70*b* sets the print timing so as to perform printing on the front face of the first one of the primary recording media in the second set (=(2)-1) at the timing before printing on the back face of the last one of the primary recording media in the first set (=(1)-2').

Moreover, the print timing setting unit 70*b* sets the print timing so as to perform printing on the secondary recording medium (=(1)-envelope) instead of feeding the second one of the primary recording media in the second set (=(2)-2).

A pattern example 5 shown in FIG. 4(*e*) will be described. In the case of the pattern example 5, the printing unit 30 performs sets of printing each including double-sided printing on one primary recording medium (sheet of content material) (A4 size in a portrait orientation) and single-sided printing on one secondary recording medium (envelope). Accordingly, the first predetermined number is 1 while the second predetermined number is 1.

First, when the receiver 70*a* of the controller 70 receives the job information, the print timing setting unit 70*b* sets the print timing for each of the primary recording medium (sheet of content material) and the secondary recording medium (envelope) based on the first predetermined number (=1) and the second predetermined number (=1).

In addition, the print timing setting unit 70*b* sets the print timing based on the number of primary recording media transferable in the transfer path at a time. In the pattern example 5, the number of primary recording media transferable in the transfer path at a time is 3 and this number is set as N. That is, the value N is 3 in the pattern example 5.

When the first predetermined number+1<N where N denotes the number of primary recording media transferable in the transfer path at a time, the print timing setting unit 70*b* sets the print timing so as to perform printing on the front face of the first one of the primary recording media in the second set at the timing before printing on the back face of the last one of the primary recording media in the first set, and to perform printing on the secondary recording medium at the timing after printing on the back face of the last one of the primary recording media in the first set.

Here, the first predetermined number is 1 and the value N is 3. Hence the first predetermined number+1<N holds true. Therefore, the print timing setting unit 70*b* sets the print timing so as to perform printing on the front face of a first one of the primary recording media in a second set (=(2)-1) at the timing before printing on the back face of the last one of the primary recording media in the first set (=(1)-1').

Moreover, the print timing setting unit 70*b* sets the print timing so as to perform printing on the secondary recording medium (=(1)-envelope) at the timing after printing on the back face of the last one of the primary recording media in the first set (=(1)-1').

Regarding other operating patterns, the above-described rules cannot apply when N=2. Accordingly, as a first option, the recording media may be fed on the envelop size basis. This feeding may be efficient when there are not many sheets of content material. Alternatively, as a second option, the recording media may be fed one by one in accordance with an ordinary pattern. More specifically, one set of printing for one copy is completed by double-sided printing on a first predetermined number of sheets of content material is performed continuously and then single-sided printing on a second predetermined number (=1) of envelope. The set of printing is repeated multiple times to make printing of multiple copies. This method is applicable in a case where the method is simpler and more efficient than otherwise. In another alternative method, printing on the envelope in the second predetermined number (=1) may be performed before feeding the last sheet of content material in the first predetermined number. Although any of the methods described above may be used for scheduling, the former method is preferably used to simplify the scheduling.

Further, the number of sheets of content material may also vary among the sets. However, this case does not have any problem by applying the above-described rules. Moreover, the sheets of content material in one set may also have difference sizes. In this case, the sheets of content material may be fed on a largest sheet of content material basis.

Note that an unillustrated direct mail forming apparatus serving as a post-processing apparatus is connected to the image forming apparatus 1, and these apparatuses collectively constitute a direct mail forming system. The direct mail forming apparatus forms direct mails continuously by using any of the primary recording media and the secondary recording media formed by the image forming apparatus 1 as the envelopes while using the other media as the sheets of content material. The direct mail forming system of this embodiment forms direct mails continuously by using the primary recording media as the sheets of content material and using the secondary recording media as the envelopes.

In other words, the direct mail forming apparatus is an apparatus configured to form direct mails, other forms or the like by, for example, folding and binding the envelopes and the sheets of content material printed by the image forming apparatus 1. A conventional apparatus can be used as the direct mail forming apparatus.

As described above, the image forming apparatus 1 according to Embodiment 1 of the present invention includes the print timing setting unit 70*b* configured to appropriately set the print timing of the primary recording medium as a target for double-sided printing and of the secondary recording medium as a target for single-sided printing. Hence it is possible to reduce the time to complete printing with the simple structure and to improve productivity even when it is necessary to perform the single-sided printing and the double-sided printing on the recording media having different sheet sizes.

In addition, according to the image forming apparatus 1 of this embodiment, the print timing is set based on the number of primary recording media or the secondary recording media transferable in the transfer path at a time. Thus, the print timing can be set more appropriately to improve productivity.

Moreover, the image forming apparatus 1 of this embodiment can set the print timing more appropriately, as follows, to improve productivity. Specifically, when the first predetermined number+1≥N where N denotes the number of primary recording media transferable in the transfer path at a time, the print timing is set to perform printing on the front face of the first one of the primary recording media in the second set at the timing of printing on the back face of the (N−2)-th one of the primary recording media counted from the last in the first set, and to perform printing on the secondary recording medium instead of feeding the (N−1)-th one of the primary recording media in the second set.

Furthermore, the image forming apparatus 1 of this embodiment can set the print timing more appropriately, as follows, to improve productivity. Specifically, when the first predetermined number+1<N where N denotes the number of primary recording media transferable in the transfer path at a time, the print timing is set to perform printing on the front face of the first one of the primary recording media in the second set at the timing before printing on the back face of the last one of the primary recording media in the first set, and to perform printing on the secondary recording medium at the timing after printing on the back face of the last one of the primary recording media in the first set.

In summary, when the envelope is formed by single-sided printing and the sheet of content material is formed by double-sided printing, the image forming apparatus 1 of this embodiment can improve productivity by changing the paper feed timing depending on the number of sheets N in the path and on the number of sheets of content material to be fed to the path (the first predetermined number).

Moreover, according to the direct mail forming system of this embodiment, the direct mail forming apparatus as the post-processing apparatus connected to the above-described image forming apparatus 1 is used for continuously forming the direct mails while using any of the primary recording media and the second media as the envelopes and using the other media as the sheets of content material. Accordingly, it is possible to carry out the series of operations in line and to form a large amount of direct mails efficiently in a short time.

Figure 1:
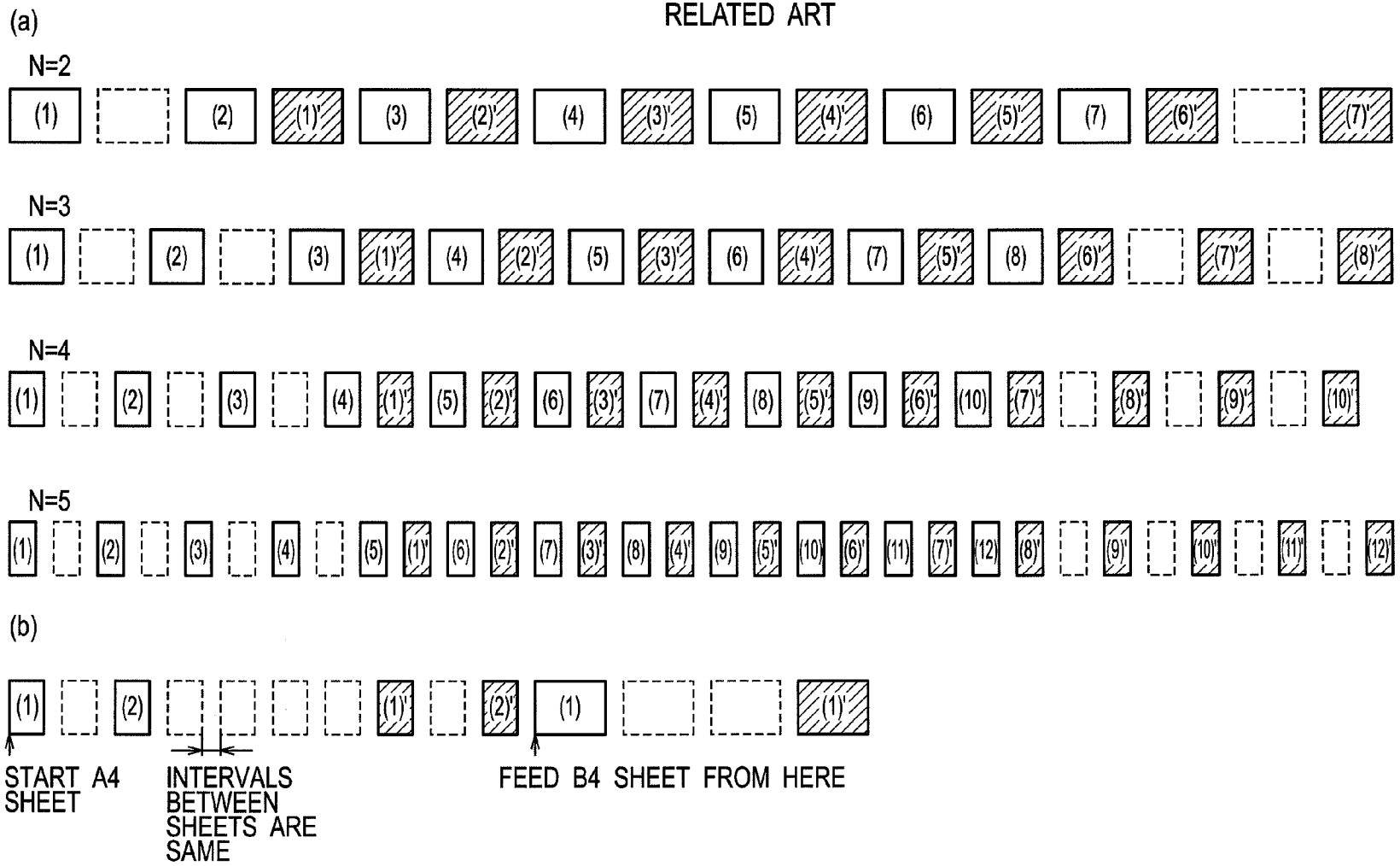
FIG. 1 RELATED ART
FIGS. 1(*a*) and 1(*b*) are explanatory views schematically showing examples of double-sided printing patterns using an image forming apparatus of a related art.

FIG. 5 is a table showing comparison in time required for printing on primary recording media and secondary recording media in one set by using the image forming apparatus 1 according to the related art and this embodiment of the present invention. The "related art" in FIG. 5 represents the case of performing single-sided printing on the second medium after completion of double-sided printing on the multiple ones of the primary recording media as shown in FIG. 1(*b*) in the apparatus of the related art.

As shown in FIG. 5, the printing time is improved irrespective of the number of primary recording media. Hence it is apparent that the image forming apparatus and the direct mail forming system of this embodiment exert a remarkable effect in forming a large amount of direct mails.

Embodiment 2

Configuration of Image Forming Apparatus

The configuration of the image forming apparatus 1 of this embodiment is basically similar to the configuration of the image forming apparatus 1 shown in FIGS. 2 and 3 and described in Embodiment 1. However, the image forming apparatus 1 of this embodiment is assumed to perform single-sided printing on multiple sheets of content material and to perform double-sided printing on a single envelope. Specifically, in this embodiment, the primary paper feed unit 22*a* inside the internal paper feed unit 20 functions as the first paper feed unit of the present invention and feeds a primary recording medium (envelope) as a target for double-sided printing. Meanwhile, the primary paper feed unit 22*b* inside the internal paper feed unit 20 functions as the second paper feed unit of the present invention and feeds a secondary recording medium (sheet of content material) as a target for single-sided printing.

Moreover, in this embodiment, based on received job information, the printing unit 30 performs sets of printing each including double-sided printing on a first predetermined number of primary recording media (envelopes) fed by the first paper feed unit (the primary paper feed unit 22*a*) and single-sided printing on a second predetermined number of secondary recording media (sheets of content material) fed by the second paper feed unit (the primary paper feed unit 22*b*). Here, the first predetermined number is 1.

The print timing setting unit 70*b* sets the print timing of each of the primary recording medium (envelope) and the secondary recording media (sheets of content material) based on the first predetermined number and the second predetermined number. To be more precise, when the first predetermined number is 1, the print timing setting unit 70*b* sets the print timing so as to firstly perform printing on the front face of the primary recording medium, then to continuously perform printing on the second predetermined number of the secondary recording media, and to perform printing on the back face of the primary recording medium at the timing of completion of printing on the secondary recording media.

The print controller 70*c* functions as the controller of the present invention. The print controller 70*c* performs control to transfer the primary recording medium and the secondary recording media to the printing unit 30 based on the print timing set by the print timing setting unit 70*b*. Note that the print controller 70*c* in this embodiment is able to keep the primary recording medium on standby at the reversing unit 50 or to change the transfer speed of the circulating transfer path CR in a circulating area 45. That is, the print controller 70*c* can control the printing speed in the printing area 35, the transfer speed of the circulating transfer path CR in the circulating area 45, and the transfer speed on the reversing path independently of one another.

Specifically, when the time required for printing the second media in each of the sets is longer than the time required for transferring and reversing the primary recording medium, the print controller 70*c* performs control, based on the print timing set by the print timing setting unit 70*b*, to keep the primary recording medium after completion of printing on the front surface on standby until completion of printing on the secondary recording media and to transfer the primary recording medium to the printing unit 30 in synchronization with completion of printing on the secondary recording media.

In addition, when the time required for printing the secondary recording media in each of the sets is shorter than the time required for transferring and reversing the primary recording medium, the print controller 70*c* performs control, based on the print timing set by the print timing setting unit 70*b*, to increase the speed for reversing and transferring the primary recording medium and thereby to transfer the primary recording medium to the printing unit 30 in synchronization with completion of printing on the secondary recording medium.

Moreover, the print control unit 70*c* generates the printing instruction signal based on the image data included in the job information received by the receiver 70*a*, and outputs the printing instruction signal to cause the printing unit 30 to perform printing on the recording media.

Other configurations of the image forming apparatus 1 are the same as those of Embodiment 1 and therefore duplicated description is omitted herein.

Operation of Image Forming Apparatus

Next, operation of this embodiment configured as described above will be described. FIG. 6(*a*) is a view showing a method in a related art, i.e., an example of printing by using an apparatus of the related art. FIG. 6(*a*) is provided for the purpose of comparison with the embodiment of the present invention. FIGS. 6(*b*) and 6(*c*) show a pattern 1 and a pattern 2, respectively, which are views for explaining operations of the image forming apparatus 1 of this embodiment of the present invention.

In FIGS. 6(*a*) to 6(*c*), a rectangle drawn by a solid frame indicates a recording medium and a number in parentheses indicates a serial number of the sheet. Further, a recording medium drawn as a hollow rectangle with a solid frame indicates front-side printing. Meanwhile, a recording medium drawn as a shaded rectangle with a solid frame indicates back-side printing.

Accordingly, (1) to (4) indicate front faces of first to fourth secondary recording media (sheets of content material) and envelope (1) indicates the front face of a first primary recording medium (envelope). Meanwhile, envelope (1)' which is shaded indicates the back face of the first primary recording medium (envelope). Further, a rectangle with a broken frame indicates a transfer waiting period.

First of all, the method of the related art shown in FIG. 6(*a*) will be described. In the method of the related art, transfer of a kind of sheets is started after completion of transfer of a previous kind of sheets. Specifically, in the method of the related art, the printing unit 30 firstly performs single-sided printing on the four secondary recording media (sheets of content material) and then performs double-sided printing on the single primary recording medium (envelope). For this reason, this method requires the time for reversing and transferring the sheet from a time point of completion of printing on the front face of the envelope to a time point of start of printing on the back face thereof. Accordingly, this method has poor productivity.

The pattern 1 in FIG. 6(*b*) shows the case where the time for feeding the sheets of content material is longer than the time for re-feeding the envelope. In the pattern 1, a sheet to be re-fed is kept on standby on a reversing path (the reversing unit 50) and single-sided printing is performed between operations of double-sided printing. In the case of the pattern 1, the image forming apparatus 1 of this embodiment is operated as described below. First, when the receiver 70*a* of the controller 70 receives the job information, the print timing setting unit 70*b* sets the print timing for each of the primary recording medium (envelope) and the secondary recording media (sheets of content material) based on the first predetermined number (=1) and the second predetermined number (=4).

Specifically, since the first predetermined number is 1 as mentioned previously, the print timing setting unit 70*b* sets the print timing so as to firstly perform printing on the front face of the primary recording medium (envelope), then to continuously perform printing on the second predetermined number (=4) of the secondary recording media (sheets of content material), and to perform printing on the back face of the primary recording medium (envelope) at the timing of completion of printing on the secondary recording media.

The print controller 70*c* performs control to transfer the primary recording medium and the secondary recording media to the printing unit 30 based on the print timing set by the print timing setting unit 70*b*.

Here, in the pattern 1, the time for feeding the sheets of content material is longer than the time for re-feeding the envelope as shown in FIG. 6(*b*). Accordingly, since the time required for printing on the secondary recording media (sheets of content material) in each of the sets is longer than the time required for transferring and reversing the primary recording medium (envelope), the print controller 70*c* performs control to keep the primary recording medium (envelope) after completion of printing on the front face on standby at the reversing unit 50 until completion of printing on the secondary recording media, and then to transfer the primary recording medium (envelope) to the printing unit 30 in synchronization with completion of printing on the secondary recording media (sheets of content material).

The pattern 2 shown in FIG. 6(*c*) shows the case where the time for feeding the sheets of content material is shorter than the time for re-feeding the envelope. In the pattern 2, a horizontal transfer speed is set to a maximum speed to make the re-feed timing as early as possible. In the case of the pattern 2, the image forming apparatus 1 of this embodiment is operated as described below. First, when the receiver 70*a* of the controller 70 receives the job information, the print timing setting unit 70*b* sets the print timing for each of the primary recording medium (envelope) and the secondary recording media (sheets of content material) based on the first predetermined number (=1) and the second predetermined number (=4). This operation to be carried out by the print timing setting unit 70*b* is the same as in the pattern 1.

The print controller 70*c* performs control to transfer the primary recording medium and the secondary recording media to the printing unit 30 based on the print timing set by the print timing setting unit 70*b*.

Here, in the pattern 2, the time for feeding the sheets of content material is shorter than the time for re-feeding the envelope as shown in FIG. 6(*c*). Accordingly, since the time required for printing on the secondary recording media (sheets of content material) in each of the sets is shorter than the time required for transferring and reversing the primary recording medium (envelope), the print controller 70*c* performs control to increase the speed for reversing and transferring the first medium (envelope), and thereby to transfer the primary recording medium (envelope) to the printing unit 30 in synchronization with completion of printing on the secondary recording media (sheets of content material).

Specifically, the print control unit 70*c* can increase the transfer speed of the circulating transfer path CR in the circulating area 45 shown in FIG. 2 to a higher speed than a normal speed in order to increase the speed for transferring and reversing the primary recording medium (envelope), and thereby can put the timing for re-feeding the primary recording medium (envelope) forward.

Here, in case of printing jam during the printing on the secondary recording media (sheets of content material) for example, the print controller 70*c* can keep the primary recording medium (envelope) after completion of printing on the front face on standby at the re-feeding unit (the reversing unit 50) so that the back face of the primary recording medium (envelope) can be printed after the printing operation is resumed. In this way, it is possible to reuse the primary recording medium without waste even in the case of the printing jam, for example.

Moreover, the unillustrated direct mail forming apparatus serving as the post-processing apparatus is connected to the image forming apparatus 1, and these apparatuses collectively constitute the direct mail forming system having similar operation and effects to those of Embodiment 1.

As described above, the image forming apparatus 1 according to Embodiment 2 of the present invention includes the print timing setting unit 70*b* configured to appropriately set the print timing of the primary recording medium as a target for double-sided printing and of the secondary recording medium as a target for single-sided printing, in the same manner as in Embodiment 1. Hence it is possible to reduce the time to complete printing with the simple structure and to improve productivity even when it is necessary to perform the single-sided printing and the double-sided printing on the recording media having different sheet sizes.

In addition, the image forming apparatus 1 of this embodiment can set the print timing more appropriately, as follows, to improve productivity. Specifically, when the first predetermined number is 1, the print timing is set to perform printing on the front face of the primary recording medium (envelope) in the first place, then to continuously perform printing on the second predetermined number of the secondary recording media (sheets of content material), and then to perform printing on the back face of the primary recording medium (envelope) at the timing when printing on the second media (sheets of content material) is completed.

Moreover, the image forming apparatus 1 of this embodiment can set the print timing more appropriately, as follows, to improve productivity. Specifically, when the time required for printing the secondary recording media in the set is longer than the time required for reversing and transferring the first medium, the image forming apparatus 1 perform control to keep the primary recording medium after completion of printing on the front face on standby until completion of printing on the secondary recording media, and then to transfer the primary recording medium to the printing unit in synchronization with completion of printing on the secondary recording media.

Furthermore, the image forming apparatus 1 of this embodiment can improve the productivity by reducing the printing time per copy as follows. Specifically, when the time required for printing the secondary recording media in the set is shorter than the time required for reversing and transferring the primary recording medium, the image forming apparatus 1 performs control to increase the speed for reversing and transferring the first medium, and thereby to transfer the primary recording medium to the printing unit in synchronization with completion of printing on the secondary recording media.

FIG. 7 is a table showing comparison between times required for performing printing on one set of the primary recording media and the secondary recording media by using the related art and the image forming apparatus 1 the embodiment of the present invention. As previously shown in the method of the related art in FIG. 6(*a*), the "related art" in FIG. 7 shows the case where the apparatus of the related art performs double-sided printing on one primary recording medium after completion of single-sided printing on multiple secondary recording media. A pattern 1 and a pattern 2 shown in FIG. 7 respectively correspond to the pattern 1 and pattern 2 described in FIGS. 6(*b*) and 6(*c*).

As shown in FIG. 7, the printing time is improved both in the pattern 1 and in the pattern 2 irrespective of the number of secondary recording media. Hence it is apparent that the image forming apparatus and the direct mail forming system of this embodiment exert a remarkable effect particularly in forming a large amount of direct mails.

The image forming apparatus and the direct mail forming system according to this embodiment are applicable to an image forming apparatus capable of performing double-sided printing on a recording medium transferred on a transfer path, for example.

An image forming apparatus according to the embodiments of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An image forming apparatus comprising:

a first paper feed unit configured to feed a primary recording medium for double-sided printing;

a second paper feed unit configured to feed a secondary recording medium for single-sided printing;

a printing unit configured to perform sets of printing based on received job information, each of the sets of printing including double-sided printing on a first predetermined number of primary recording media fed by the first paper feed unit and single-sided printing on a second predetermined number of secondary recording media fed by the second paper feed unit;

a print timing setting unit configured to set a print timing of each of the first print media and the second print media based on the first predetermined number and the second predetermined number;

and a controller configured to perform control to transfer the primary recording media and the secondary recording media to the printing unit based on the print timing set by the print timing setting unit.

2. The image forming apparatus according to claim 1, wherein the print timing setting unit sets the print timing based on a number of one of the primary recording media and the secondary recording media transferable in the transfer path at a time.

3. The image forming apparatus according to claim 1, wherein when the first predetermined number+1≥N where N denotes a number of the primary recording media transferable in the transfer path at a time, the print timing setting unit sets the print timing so as to perform printing on a front face of a first one of the primary recording media in a second set of printing next to a first set of printing at timing before printing on a back face of a (N−2)-th one of the primary recording media counted from the last in the first set and to perform printing on the secondary recording medium in the first set instead of feeding a (N−1)-th one of the primary recording media in the second set.

4. The image forming apparatus according to claim 1, wherein when the first predetermined number+1<N where N denotes a number of the primary recording media transferable in the transfer path at a time, the print timing setting unit sets the print timing so as to perform printing on a front face of a first one of the primary recording media in a second set of printing next to a first set of printing at timing before printing on a back face of a last one of the primary recording media in the first set and to perform printing on the secondary recording medium in the first set at timing after printing on the back face of the last one of the primary recording media in the first set.

5. The image forming apparatus according to claim 1, wherein when the first predetermined number is 1, the print timing setting unit sets the print timing so as to firstly perform printing on a front face of the primary recording medium, then to continuously perform printing on the second predetermined number of the secondary recording media, and to perform printing on a back face of the primary recording medium at timing of completion of printing on the secondary recording media.

6. The image forming apparatus according to claim 5, wherein when time required for printing on the secondary recording media in each of the sets is longer than time required for transferring and reversing the primary recording medium, the controller performs control, based on the print timing set by the print timing setting unit, to keep the primary recording medium after completion of printing on the front face thereof on standby until completion of printing on the secondary recording media, and then to transfer the primary recording medium to the printing unit in synchronization with the completion of printing on the secondary recording media.

7. The image forming apparatus according to claim 5, wherein when time required for printing on the secondary recording media in each of the sets is shorter than time required for transferring and reversing the primary recording medium, the controller performs control, based on the print timing set by the print timing setting unit, to transfer the primary recording medium to the printing unit in synchronization with completion of printing on the secondary recording media by increasing a speed for transferring and reversing the primary recording medium.

8. The image forming apparatus according to claim 1, wherein the received job information includes both a double-sided printing instruction and a single-sided printing instruction.

* * * * *